US011147388B2

(12) United States Patent
Wise

(10) Patent No.: US 11,147,388 B2
(45) Date of Patent: Oct. 19, 2021

(54) ADJUSTABLE BEDFRAME ASSEMBLY

(71) Applicant: Raymond Wise, Landover, MD (US)

(72) Inventor: Raymond Wise, Landover, MD (US)

( * ) Notice: Subject to any disclaimer, the term of this patent is extended or adjusted under 35 U.S.C. 154(b) by 157 days.

(21) Appl. No.: 16/552,561

(22) Filed: Aug. 27, 2019

(65) Prior Publication Data

US 2021/0059422 A1 Mar. 4, 2021

(51) Int. Cl.

| | |
|---|---|
| ***A47C 20/04*** | (2006.01) |
| ***A47C 31/00*** | (2006.01) |
| ***A47C 19/02*** | (2006.01) |
| *A61G 13/00* | (2006.01) |
| *A61G 7/00* | (2006.01) |

(52) U.S. Cl.

CPC ..... *A47C 20/041* (2013.01); *A47C 19/024* (2013.01); *A47C 31/008* (2013.01); *A61G 7/00* (2013.01); *A61G 13/00* (2013.01)

(58) Field of Classification Search

CPC ..... A47C 20/04; A47C 20/041; A47C 31/008; A47C 19/024; A47C 19/12; A47C 19/122; A61G 7/00; A61G 7/002; A61G 7/005; A61G 7/015; A61G 13/00; A61G 13/02; A61G 13/04; A61G 13/08

See application file for complete search history.

(56) References Cited

U.S. PATENT DOCUMENTS

| | | | | |
|---|---|---|---|---|
| 2,211,453 | A * | 8/1940 | Buttikofer | A47C 20/041 5/634 |
| 4,667,354 | A * | 5/1987 | Carey, Jr. | A61G 1/0212 248/654 |
| 4,751,755 | A * | 6/1988 | Carey, Jr. | A61G 7/002 5/614 |
| 4,961,236 | A * | 10/1990 | Luconi | A47C 20/041 5/616 |
| 4,989,281 | A * | 2/1991 | Christensen | B62D 33/0612 296/190.02 |
| 5,481,770 | A * | 1/1996 | Ahlsten | A61G 1/00 5/185 |
| 5,502,853 | A * | 4/1996 | Singleton | A47C 21/006 5/185 |
| 5,575,026 | A * | 11/1996 | Way | A61G 1/0567 5/611 |
| 5,667,529 | A * | 9/1997 | Butner | A61G 13/009 5/617 |
| 6,681,425 | B2 | 1/2004 | Leventhal | |
| 7,478,447 | B2 | 1/2009 | Wilming | |

(Continued)

*Primary Examiner* — Peter M. Cuomo
*Assistant Examiner* — Rahib T Zaman

(57) ABSTRACT

An adjustable bedframe assembly for enhancing comfort and spinal alignment includes a plurality of legs that is coupled to and extends from a frame to support the frame on a substantially horizontal surface. A first plate that is coupled to a head rail and a pair of opposing side rails of the frame extends from the head rail to proximate to a midline of the pair of opposing side rails. A second plate that is pivotally coupled to the first plate extends to proximate to a foot rail of the frame so that the second plate and the first plate are configured to support a mattress. An actuator that is coupled to the second plate is positioned to selectively pivot the second plate relative to the first plate. The second plate is configured to selectively lower and raise a section of the mattress that is positioned on the second plate.

10 Claims, 4 Drawing Sheets

(56) References Cited

U.S. PATENT DOCUMENTS

| | | | | |
|---|---|---|---|---|
| 8,020,486 | B2 * | 9/2011 | Yamamoto | F15B 11/044 91/515 |
| 8,266,746 | B2 | 9/2012 | Oh | |
| 8,484,781 | B2 | 7/2013 | Kong | |
| 8,533,878 | B2 * | 9/2013 | Wu | A61G 7/015 5/616 |
| D707,462 | S | 6/2014 | McCarty | |
| 9,918,555 | B2 * | 3/2018 | Gopalakrishnan | A47C 19/021 |
| 2005/0011005 | A1 * | 1/2005 | Borda | A47C 20/04 5/412 |
| 2009/0211028 | A1 * | 8/2009 | Richmond | A47C 20/08 5/618 |
| 2010/0199433 | A1 * | 8/2010 | Clenet | A61G 7/0521 5/618 |
| 2011/0175417 | A1 | 7/2011 | Peled | |
| 2011/0247144 | A1 | 10/2011 | Oh | |
| 2012/0233781 | A1 * | 9/2012 | Farre | A61H 19/50 5/616 |
| 2014/0201915 | A1 | 7/2014 | Ermalovich | |

* cited by examiner

ADJUSTABLE BEDFRAME ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bedframe assemblies and more particularly pertains to a new bedframe assembly for enhancing comfort and spinal alignment.

(2) Description of Related Art Including Information Disclosed Under 37 CFR 1.97 and 1.98

The prior art relates to bedframe assemblies.

BRIEF SUMMARY OF THE INVENTION

An embodiment of the disclosure meets the needs presented above by generally comprising a plurality of legs that is coupled to and extends from a frame to support the frame on a substantially horizontal surface. A first plate that is coupled to a head rail and a pair of opposing side rails of the frame extends from the head rail to proximate to a midline of the pair of opposing side rails. A second plate that is pivotally coupled to the first plate extends to proximate to a foot rail of the frame so that the second plate and the first plate are configured to support a mattress. An actuator that is coupled to the second plate is positioned to selectively pivot the second plate relative to the first plate. The second plate is configured to selectively lower and raise a section of the mattress that is positioned on the second plate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
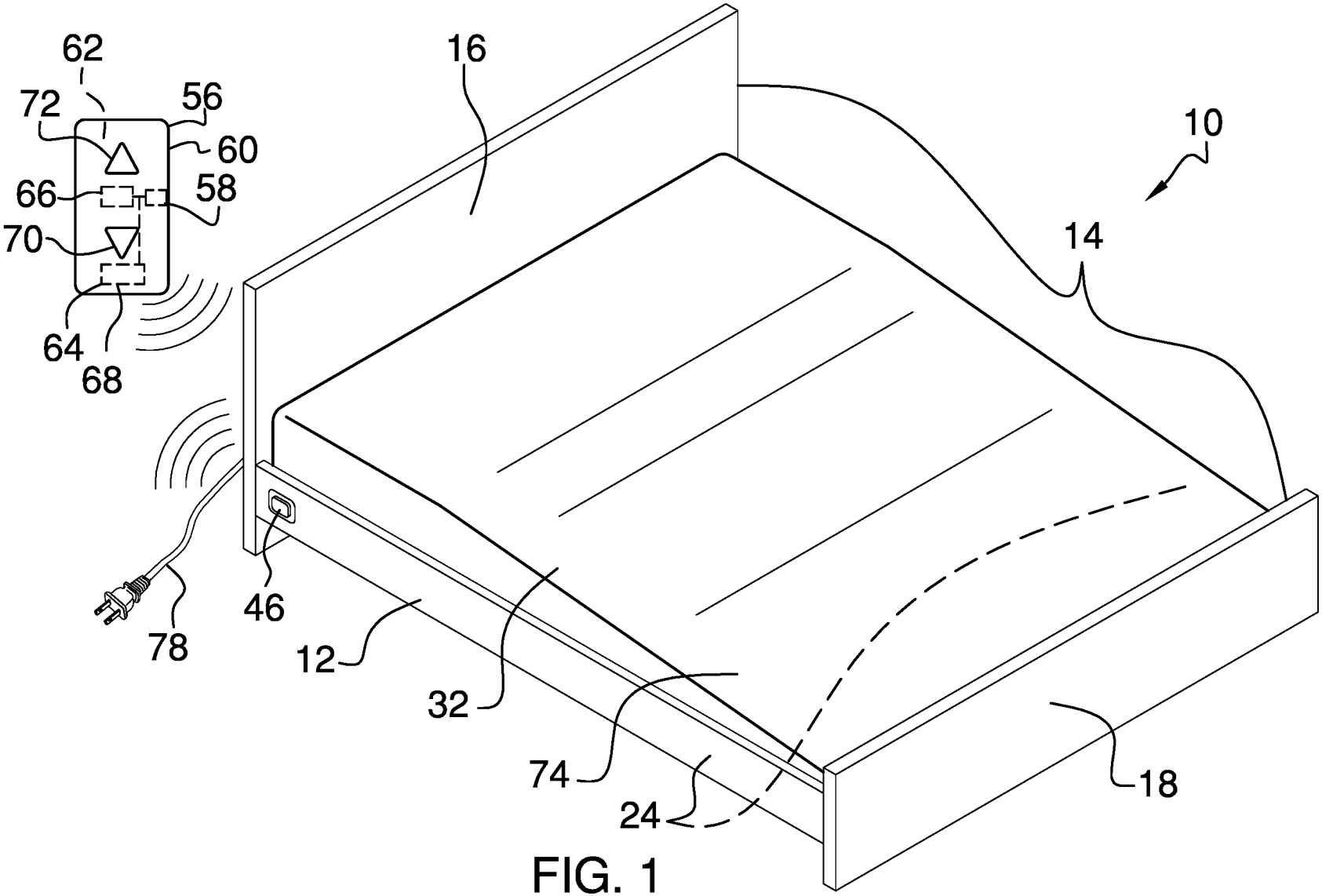
FIG. 1 is an isometric perspective view of an adjustable bedframe assembly according to an embodiment of the disclosure.
Figure 2:
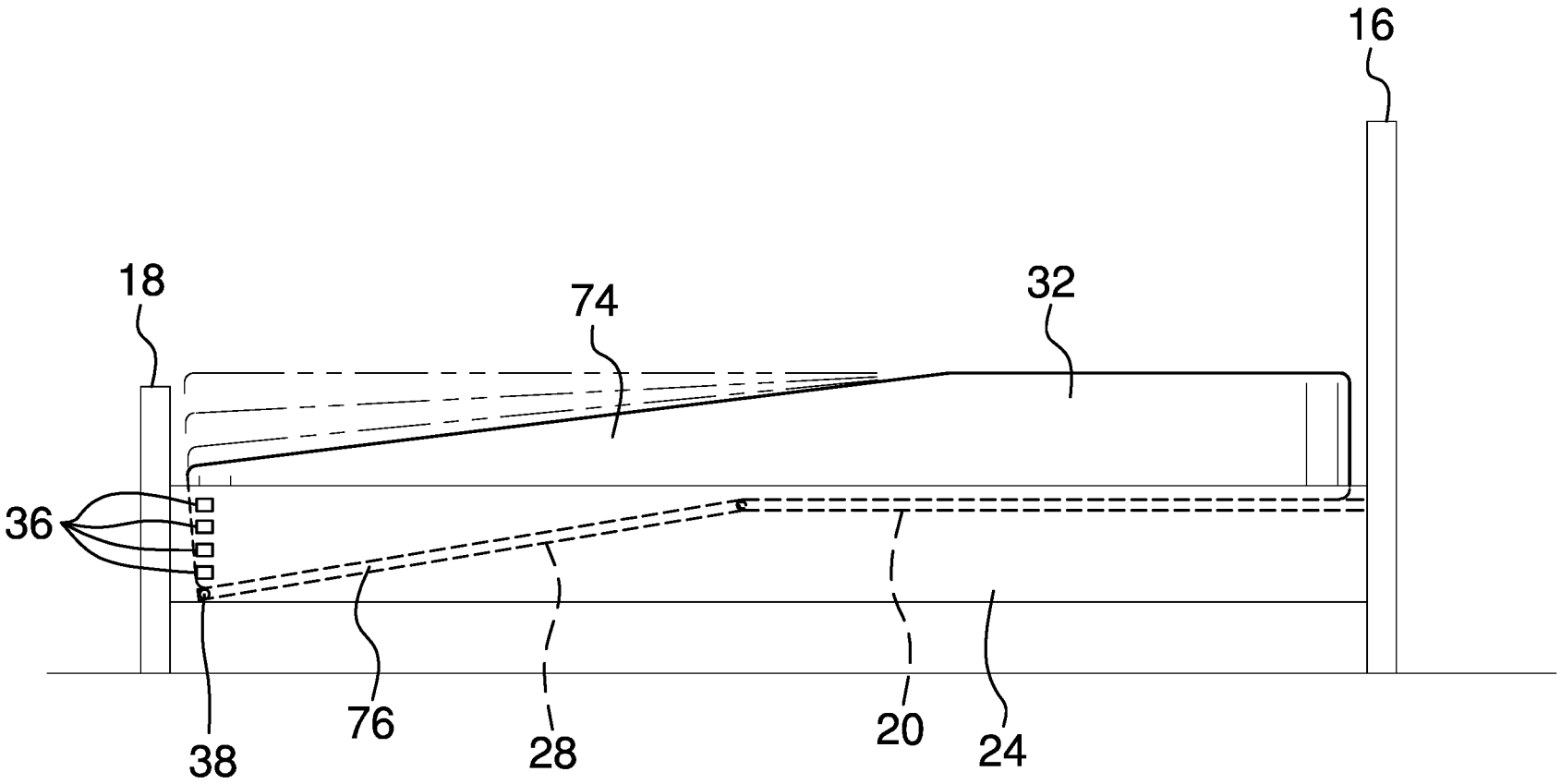
FIG. 2 is a side view of an embodiment of the disclosure.
Figure 3:
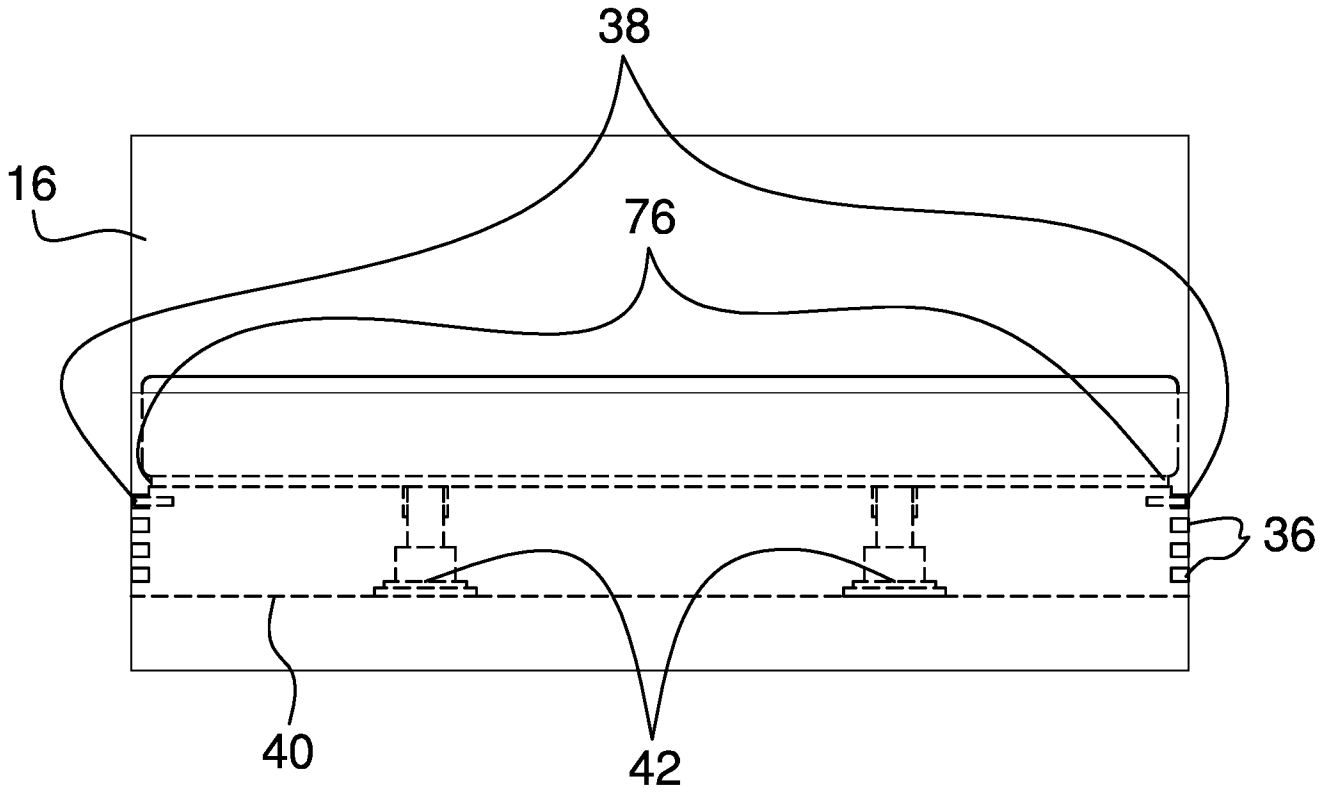
FIG. 3 is an end view of an embodiment of the disclosure.
Figure 4:
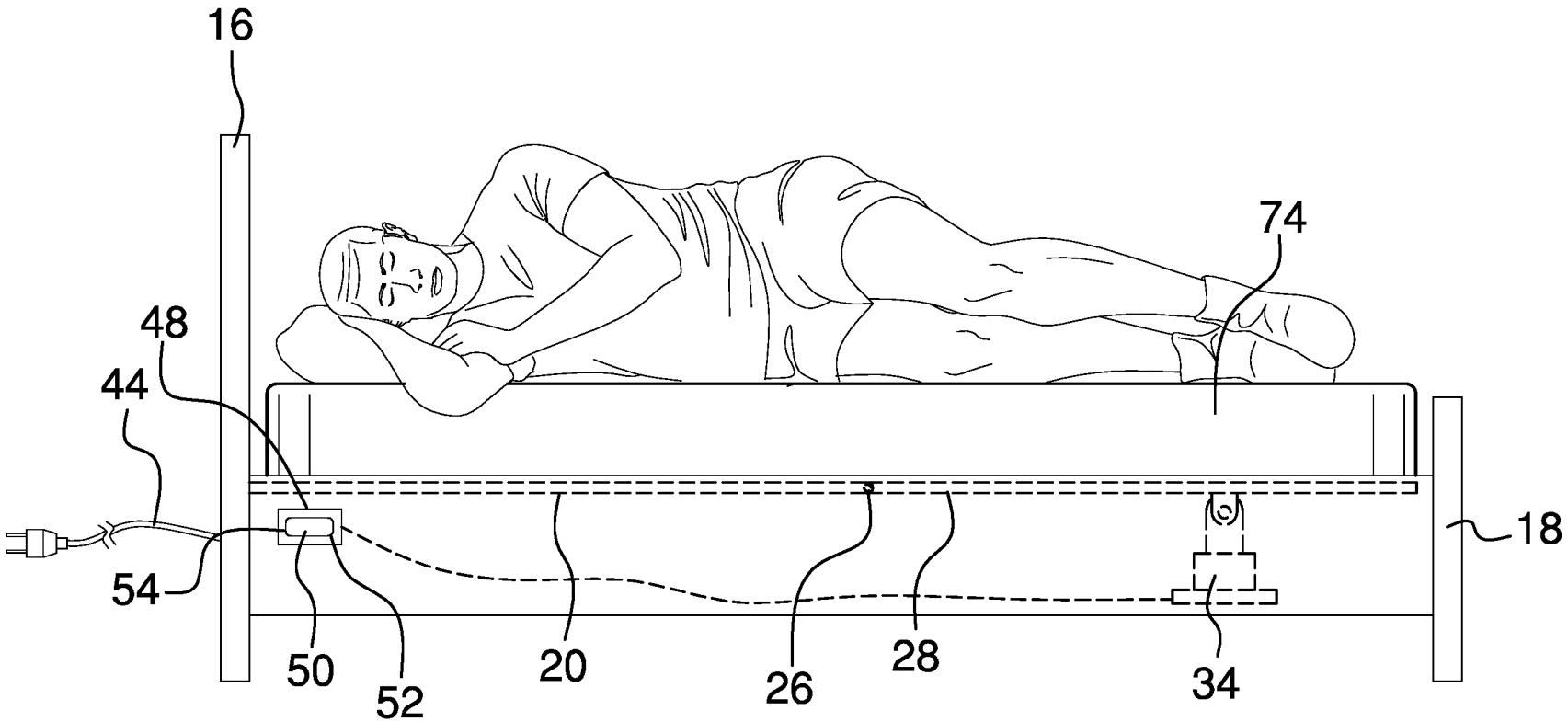
FIG. 4 is an in-use view of an embodiment of the disclosure.

With reference now to the drawings, and in particular to FIGS. 1 through 4 thereof, a new bedframe assembly embodying the principles and concepts of an embodiment of the disclosure and generally designated by the reference numeral 10 will be described.

As best illustrated in FIGS. 1 through 4, the adjustable bedframe assembly 10 generally comprises a frame 12. A plurality of legs 14 that is coupled to and extends from the frame 12 is configured to support the frame 12 on a substantially horizontal surface. The plurality of legs 14 comprises a head board 16 and a foot board 18.

A first plate 20 is coupled to a head rail 22 and a pair of opposing side rails 24 of the frame 12. The first plate 20 extends from the head rail 22 to proximate to a midline 26 of the pair of opposing side rails 24. A second plate 28 that is pivotally coupled to the first plate 20 extends to proximate to a foot rail 30 of the frame 12 so that the second plate 28 and the first plate 20 are configured to support a mattress 32.

An actuator 34 that is coupled to the second plate 28 is positioned to selectively pivot the second plate 28 relative to the first plate 20. The second plate 28 is configured to selectively lower and raise a section 74 of the mattress 32 that is positioned on the second plate 28.

Each of a plurality of notches 36 is positioned in a respective opposing side rail 24. Each of a pair of pins 38 is coupled to a respective opposing edge 76 of the second plate 28. The pin 38 is spring loaded, biasing the pin 38 to an extended configuration wherein the pin 38 extends from the second plate 28 into a respective notch 36 so that the second plate 28 is fixedly positioned. The pin 38 is configured to be extracted from the respective notch 36, enabling a user to selectively pivot the second plate 28 relative to the first plate 20 to selectively lower and raise the section 74 of the mattress 32 that is positioned on the second plate 28. The pin 38 is configured to be released so that the pin 38 inserts into a selected notch 36 to fixedly position the second plate 28.

A plank 40 is coupled to and extends between the pair of opposing side rails 24. The actuator 34 comprises a pair of linear actuators 42, each of which is coupled to and extends between the plank 40 and the second plate 28. The pair of linear actuators 42 is positioned to selectively pivot the second plate 28 relative to the first plate 20 so that the second plate 28 is configured to selectively lower and raise the section 74 of the mattress 32 that is positioned on the second plate 28.

A first power module 44 and a controller 46 are coupled to the frame 12. The first power module 44 comprises a power cord 78. The controller 46 is operationally coupled to the actuator 34 and the first power module 44. The controller 46 is configured to selectively actuate the actuator 34 to lower and raise the second plate 28.

The controller 46 comprises a receiver 48 and a switch 50. The switch 50 is rocker type so that a first end 52 of the switch 50 is configured to be depressed to lower the second plate 28 and a second end 54 of the switch 50 is configured to be depressed to raise the second plate 28. The switch 50 is configured to default to a neutral position when both the first end 52 and the second end 54 are undepressed.

The assembly 10 also comprises a remote control 56, which comprises a transmitter 58 so that the remote control 56 is positioned to selectively communicate a lower command and a raise command to the controller 46 via the receiver 48.

The remote control 56 comprises a housing 60 that defines an internal space 62. The transmitter 58, a second power module 64, and a microprocessor 66 are coupled to the housing 60 and positioned in the internal space 62. The second power module 64 comprises a battery 68. The microprocessor 66 is operationally coupled to the second power module 64 and the transmitter 58.

A first button 70 and a second button 72 are coupled to the housing 60. The first button 70 and the second button 72 are operationally coupled to the microprocessor 66. The first button 70 and the second button 72 are depressible. The first button 70 is configured to be depressed to signal the microprocessor 66 to command the transmitter 58 to communicate the lower command to the controller 46 via the receiver 48. The second button 72 is configured to be depressed to signal the microprocessor 66 to command the transmitter 58 to communicate the raise command to the controller 46 via the receiver 48.

In use, the mattress 32 is positioned on the first plate 20 and the second plate 28. The user adjusts the angle of the second plate 28 relative to the first plate 20, either by using the actuator 34 or by manually positioning each pin 38 into a selected notch 36. The angle of the mattress 32 can be adjusted to optimize comfort and alignment of the spine.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adjustable bedframe assembly comprising:

a frame;

a plurality of legs coupled to and extending from the frame wherein the legs are configured for supporting the frame on a substantially horizontal surface;

a first plate coupled to a head rail and a pair of opposing side rails of the frame, the first plate extending from the head rail to proximate to a midline of the pair of opposing side rails;

a second plate pivotally coupled to the first plate, the second plate extending to proximate to a foot rail of the frame wherein the second plate and the first plate are configured for supporting a mattress;

an actuator couple to the second plate such that the actuator is positioned for selectively pivoting the second plate relative to the first plate wherein the second plate is configured for selectively lowering and raising a section of the mattress positioned on the second plate;

a plurality of notches, each notch being positioned in a respective opposing side rail; and a pair of pins, each pin being coupled to a respective opposing edge of the second plate, each pin being spring loaded such that each pin is biased to an extended configuration such that each pin extends from the second plate into a respective notch such that the second plate is fixedly positioned wherein each pin is configured for extracting from the respective notch enabling a user for selectively the second plate relative to the first plate for selectively lowering and raising the section of the mattress positioned on the second plate and for releasing each pin such that each pin inserts into a selected notch for fixedly positioning the second plate.

2. The assembly of claim 1, further including the frame being rectangularly shaped.

3. The assembly of claim 1, further including the plurality of legs comprising a head board and a foot board.

4. The assembly of claim 1, further comprising:

a plank coupled to and extending between the pair of opposing side rails, the actuator comprising a pair of linear actuators, each linear actuator being coupled to and extending between the plank and the second plate wherein the pair of linear actuators is positioned for selectively pivoting the second plate relative to the first plate wherein the second plate is configured for selectively lowering and raising the section of the mattress positioned on the second plate;

a first power module coupled to the frame; and a controller coupled to the frame, the controller being operationally coupled to the actuator and the first power module wherein the controller is configured for selectively actuating the actuator for lowering and raising the second plate.

5. The assembly of claim 4, further including the first power module comprising a power cord.

6. The assembly of claim 4, further including the controller comprising a switch, the switch being rocker type such that a first end of the switch is configured for depressing for lowering the second plate and a second end of the switch is configured for depressing for raising the second plate and wherein the switch is configured for defaulting to a neutral position when both the first end and the second end are undepressed.

7. The assembly of claim 4, further comprising:

the controller comprising a receiver; and a remote control comprising a transmitter wherein the remote control is positioned for selectively communicating a lower command and a raise command to the controller via the receiver.

8. The assembly of claim 7, further including the remote control comprising:

a housing defining an internal space, the transmitter being coupled to the housing and positioned in the internal space;

a second power module coupled to the housing and positioned in the internal space;

a microprocessor coupled to the housing and positioned in the internal space, the microprocessor being operationally coupled to the second power module and the transmitter; and a first button and a second button coupled to the housing, the first button and the second button being operationally coupled to the microprocessor, the first button and the second button being depressible wherein the first button is configured for depressing for signaling the microprocessor for commanding the transmitter for communicating the lower command to the controller via the receiver and wherein second button is configured for depressing for signaling the microprocessor for commanding the transmitter for communicating the raise command to the controller via the receiver.

9. The assembly of claim 8, further including the second power module comprising a battery.

10. An adjustable bedframe assembly comprising:

a frame, the frame being rectangularly shaped;

a plurality of legs coupled to and extending from the frame wherein the legs are configured for supporting the frame on a substantially horizontal surface, the plurality of legs comprising a head board and a foot board;

a first plate coupled to a head rail and a pair of opposing side rails of the frame, the first plate extending from the head rail to proximate to a midline of the pair of opposing side rails;

a second plate pivotally coupled to the first plate, the second plate extending to proximate to a foot rail of the frame wherein the second plate and the first plate are configured for supporting a mattress;

an actuator couple to the second plate such that the actuator is positioned for selectively pivoting the second plate relative to the first plate wherein the second plate is configured for selectively lowering and raising a section of the mattress positioned on the second plate;

a plurality of notches, each notch being positioned in a respective opposing side rail;

a pair of pins, each pin being coupled to a respective opposing edge of the second plate, each pin being spring loaded such that each pin is biased to an extended configuration such that each pin extends from the second plate into a respective notch such that the second plate is fixedly positioned wherein each pin is configured for extracting from the respective notch enabling a user for selectively pivoting the second plate relative to the first plate for selectively lowering and raising the section of the mattress positioned on the second plate and for releasing each pin such that each pin inserts into a selected notch for fixedly positioning the second plate;

a plank coupled to and extending between the pair of opposing side rails, the actuator comprising a pair of linear actuators, each linear actuator being coupled to and extending between the plank and the second plate wherein the pair of linear actuators is positioned for selectively pivoting the second plate relative to the first plate wherein the second plate is configured for selectively lowering and raising the section of the mattress positioned on the second plate;

a first power module coupled to the frame, the first power module comprising a power cord;

a controller coupled to the frame, the controller being operationally coupled to the actuator and the first power module wherein the controller is configured for selectively actuating the actuator for lowering and raising the second plate, the controller comprising a receiver, the controller comprising a switch, the switch being rocker type such that a first end of the switch is configured for depressing for lowering the second plate and a second end of the switch is configured for depressing for raising the second plate and wherein the switch is configured for defaulting to a neutral position when both the first end and the second end are undepressed; and a remote control comprising a transmitter wherein the remote control is positioned for selectively communicating a lower command and a raise command to the controller via the receiver, the remote control comprising:

a housing defining an internal space, the transmitter being coupled to the housing and positioned in the internal space, a second power module coupled to the housing and positioned in the internal space, the second power module comprising a battery, a microprocessor coupled to the housing and positioned in the internal space, the microprocessor being operationally coupled to the second power module and the transmitter, and a first button and a second button coupled to the housing, the first button and the second button being operationally coupled to the microprocessor, the first button and the second button being depressible wherein the first button is configured for depressing for signaling the microprocessor for commanding the transmitter for communicating the lower command to the controller via the receiver and wherein second button is configured for depressing for signaling the microprocessor for commanding the transmitter for communicating the raise command to the controller via the receiver.

* * * * *